US005164071A

United States Patent [19]

Harandi

[11] Patent Number: 5,164,071

[45] Date of Patent: Nov. 17, 1992

[54] FLUIDIZED CATALYST PROCESS FOR UPGRADING OLEFINS

[75] Inventor: Mohsen N. Harandi, Lawrenceville, N.J.

[73] Assignee: Mobil Oil Corporation, Fairfax, Va.

[21] Appl. No.: 662,160

[22] Filed: Feb. 28, 1991

Related U.S. Application Data

[63] Continuation-in-part of Ser. No. 339,466, Apr. 17, 1989, Pat. No. 5,000,837.

[51] Int. Cl.[5] ..... C10G 51/02

[52] U.S. Cl. ..... 208/67; 208/164; 208/147; 208/149

[58] Field of Search ..... 585/330; 208/49, 67, 208/71, 164, 147, 149

[56] References Cited

U.S. PATENT DOCUMENTS

| | | | |
|---|---|---|---|
| 4,527,001 | 7/1985 | Kaiser | 585/643 |
| 4,556,753 | 12/1985 | Debran | 585/643 |
| 4,613,721 | 9/1986 | Kaiser | 585/643 |
| 4,746,762 | 5/1988 | Avidan et al. | 585/415 |
| 4,822,477 | 4/1989 | Avidan et al. | 208/70 |
| 4,886,925 | 12/1989 | Harandi | 585/331 |
| 5,000,837 | 3/1991 | Harandi | 208/67 |

FOREIGN PATENT DOCUMENTS 0026041 12/1980 European Pat. Off. .

OTHER PUBLICATIONS

"Conversion of $C_2$-$C_{10}$ to higher Olefins over Synthetic Zeolite ZSM-5", W. E. Garwood, ACS Symposium Series, No. 218, 384-396, (1983).

*Primary Examiner*—Olik Chaudhuri
*Assistant Examiner*—G. Fourson
*Attorney, Agent, or Firm*—Alexander J. McKillop; Charles J. Speciale; L. G. Wise

[57] ABSTRACT

An improvement in iso-olefin production without substantial decrease in overall yield is obtained in an integrated process combining a fluidized catalytic cracking reaction and a fluidized catalyst olefin interconversion reaction when crystalline medium pore shape selective zeolite catalyst particles are withdrawn in partially deactivated form from the interconversion reaction stage and added as part of the active catalyst in the FCC reaction.

12 Claims, 1 Drawing Sheet

FLUIDIZED CATALYST PROCESS FOR UPGRADING OLEFINS

CROSS-REFERENCE TO RELATED APPLICATION

Figure 1:
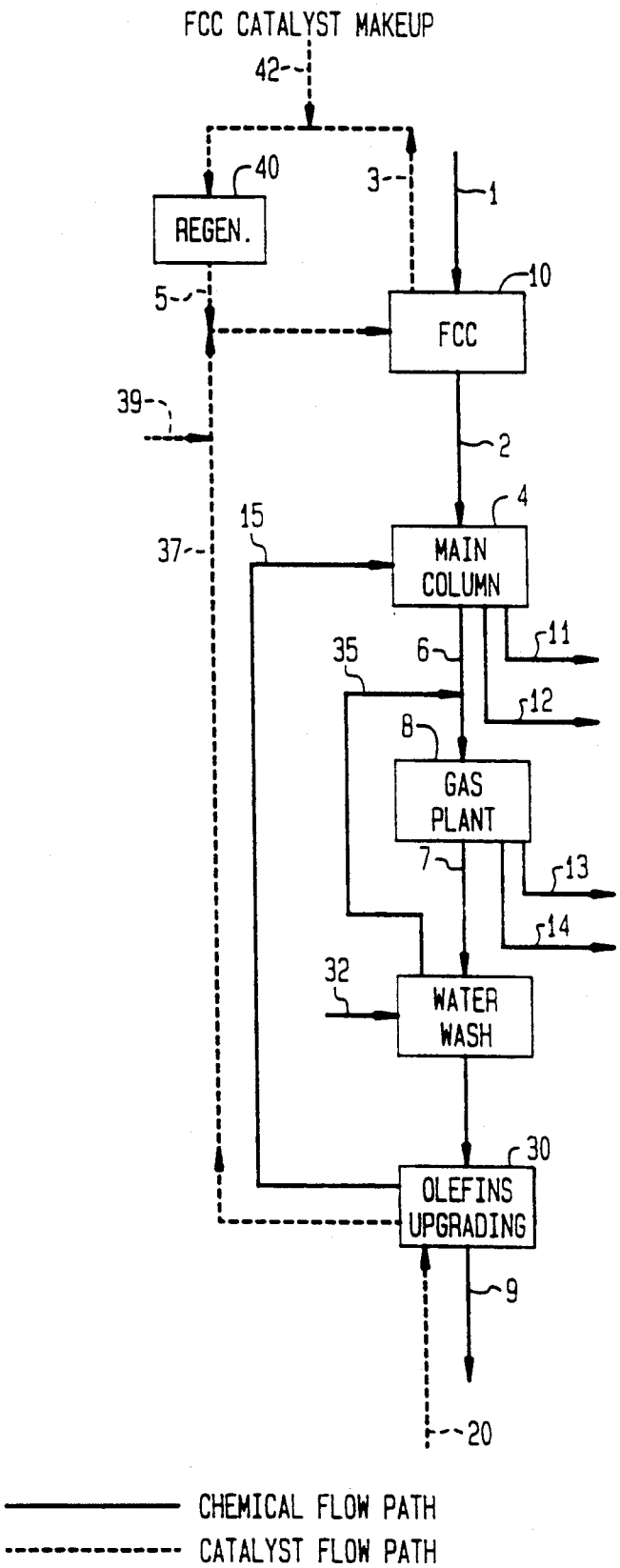

This application is a continuation-in-part of U.S. patent application Ser. No. 07/339,466, filed Apr. 17. 1989 (Harandi/U.S. Pat. No. 5,000,837).

BACKGROUND OF THE INVENTION

This invention relates to a catalytic technique for cracking heavy petroleum stocks and upgrading light olefin gas to valuable olefinic hydrocarbons. In particular, it provides a continuous integrated process for isomerizing and oligomerizing olefinic light gas byproduct of FCC cracking to produce $C_4$ + hydrocarbons, such as iso-olefin, olefinic gasoline or high quality distillate. Ethene, propene and/or butene containing gases, byproducts of petroleum cracking in a fluidized catalytic cracking (FCC) unit, may be upgraded by contact with a crystalline medium pore siliceous zeolite catalyst.

Developments in zeolite catalysis and hydrocarbon conversion processes have created interest in utilizing olefinic feedstocks for producing $C_4$–$C_5$ tertiary olefins, gasoline, etc. In addition to basic chemical reactions promoted by zeolite catalysts having a ZSM-5 structure, a number of discoveries have contributed to the development of new industrial processes. These are safe, environmentally acceptable processes for utilizing feedstocks that contain lower olefins, especially $C_2$–$C_4$ alkenes.

Conversion of lower olefins, especially propene and butenes, over HZSM-5 is effective at moderately elevated temperatures and pressures. The conversion products are sought as chemical feedstocks and liquid fuels, especially the $C_4$ + aliphatic hydrocarbons. Product distribution for hydrocarbons can be varied by controlling process conditions, such as temperature, pressure, catalyst activity and space velocity.

At low pressure and moderately high temperature, thermodynamics restrict the olefin distribution to relatively low molecular weight. This is the basis for the olefin interconversion process, i.e., to operate under conditions where lower olefins, such as $C_2$–$C_4$ olefins can be converted to an equilibrium distribution of olefins with iso-butenes and iso-pentenes maximized. The Mobil Olefin Interconversion ("MOI") process as utilized in the present invention can use fixed bed, moving bed or fluid bed reactors containing zeolite type catalysts such as ZSM-5. Operating conditions encompass temperatures between 250° and 550° C. and low pressures, generally between 100 and 1500 kPa. Gasoline ($C_5$–$C_{10}$) is also formed at elevated temperature (e.g., up to about 400° C.) and moderate pressure from ambient to about 5500 kPa, preferably about 250 to 2900 kPa. Olefinic gasoline can be produced and may be recovered as a product or fed to a low severity, high pressure reactor system for further conversion to heavier distillate-range products.

Recently it has been found that olefinic light gas can be upgraded to hydrocarbons rich in iso-olefins by catalytic conversion in a fluidized bed of solid medium pore acid zeolite catalyst under effective reaction severity conditions. Such a fluidized bed operation typically requires oxidative regeneration of coked catalyst to restore zeolite acidity for further use, while withdrawing spent catalyst and adding fresh acid zeolite to maintain the desired average catalyst activity in the bed. This technique is particularly useful for upgrading FCC light gas, which usually contains significant amounts of ethene, propene, $C_1$–$C_4$ paraffins and hydrogen produced in cracking heavy petroleum oils or the like. Furthermore, it has been found that $C_6$+ olefinic components can be interconverted to iso-olefin rich $C_5$− over medium pore zeolites. Therefore, $C_6$+ olefins made during the course of light olefin interconversion can be recycled to the same reactor to produce additional $C_4$–$C_5$ iso-olefins.

Alternatively, the $C_6$+ olefins can be more selectively upgraded in another interconversion reactor operating under conditions to maximize $C_4$–$C_5$ iso-olefins yield.

Economic benefits and increased product quality can be achieved by integrating the FCC and olefin interconversion units in a novel manner. It is the primary object of this invention to eliminate the olefins upgrading catalyst regeneration system which results in significant process investment saving and improved process safety. Another object of this invention is to eliminate the olefins upgrading spent catalyst stripper which results in significant process investment/operating cost saving. Another object of the present invention is to further extend the usefulness of the medium pore acid zeolite catalyst used in the olefinic light gas upgrading reaction by withdrawing a portion of partially deactivated and coked zeolite catalyst and admixing the withdrawn portion with cracking catalyst in a primary FCC reactor stage. Prior efforts to increase the octane rating of FCC gasoline by addition of zeolites having a ZSM-5 structure to large pore cracking catalysts have resulted in a small decrease in gasoline yield, increase in gasoline quality, and increase in light olefin byproduct.

SUMMARY OF THE INVENTION

It has been found that an olefins interconversion process can be advantageously operated to produce highly iso-olefinic $C_4$ + hydrocarbons. The reaction coke make is generally less than 0.1% of olefins feed and preferably less than 0.02 wt. % of olefins feed. Considering the low coke make and low operating severity, so that the $C_5$+ components formed during the course of the reaction contain less than 25% aromatics and paraffins combined, the catalyst deactivation rate is very slow. The olefins upgrading reaction severity can be adjusted by catalyst activity, WHSV, temperature, and/or pressure. Heavy hydrocarbons such as vacuum gas oil or residuum are contacted with particles of a first large pore cracking catalyst component and preferably similar size particles of a second medium pore siliceous zeolite catalyst component under cracking conditions to obtain a product comprising lower boiling hydrocarbons including intermediate gasoline, distillate range hydrocarbons, and lower olefins. The lower olefins are separated from the heavier products and contacted in a secondary fluidized bed reaction stage with medium pore siliceous zeolite catalyst under low reaction severity conditions effective to upgrade at least a portion of the lower molecular weight olefins to olefinic $C_4$ + hydrocarbons, rich in isobutylene and isoamylenes. This results in depositing carbonaceous material onto the solid catalyst, which is allowed to build up on the catalyst so that the coke on the catalyst is up to 10 wt. %. Catalyst is continuously or batch wise is made up and withdrawn to maintain the required catalyst activity. The withdrawn spent catalyst is sent to the primary fluid bed reaction zone as an octane enhancer.

The medium pore zeolite catalyst makeup of a primary stage FCC unit and a secondary stage olefins interconversion unit can be balanced by varying operating severity of the secondary stage.

Fluidized Catalytic Cracking-FCC Reactor Operation

In conventional fluidized catalytic cracking processes, a relatively heavy hydrocarbon feedstock, e.g., a gas oil, is admixed with hot cracking catalyst, e.g., a large pore crystalline zeolite such as zeolite Y, to form fluidized suspension. A fast transport bed reaction zone produces cracking in an elongated riser reactor at elevated temperature to provide a mixture of lighter hydrocarbon crackate products. The gasiform reaction products and spent catalyst are discharged from the riser into a solids separator, e.g., a cyclone unit, located within the upper section of an enclosed catalyst stripping vessel, or stripper, with the reaction products being conveyed to a product recovery zone and the spent catalyst entering a dense bed catalyst regeneration zone within the lower section of the stripper. In order to remove entrained hydrocarbon product from the spent catalyst prior to conveying the latter to a catalyst regenerator unit, an inert stripping gas, e.g., steam, is passed through the catalyst where it strips such hydrocarbons conveying them to the product recovery zone. The fluidized cracking catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and U.S. Pat. Nos. 3,748,251, 3,849,291, 3,894,931, 3,894,933, 3,894,934, 3,894,935, 3,926,778, 3,928,172, 3,974,062 and 4,116,814 (multiple risers), incorporated herein by reference.

Several of these processes employ a mixture of catalysts having different catalytic properties as, for example, the catalytic cracking process described in U.S. Pat. No. 3,894,934 which utilizes a mixture of a large pore crystalline zeolite cracking catalyst such as zeolite Y and shape selective medium pore crystalline metallosilicate zeolite such as ZSM-5. Each catalyst contributes to the function of the other to produce a gasoline product of relatively high octane rating.

A fluidized catalytic cracking process in which a cracking catalyst such as zeolite Y is employed in combination with a shape selective medium pore crystalline include the synthetic faujasite zeolites X and Y with particular preference being accorded zeolites Y, REY, USY and RE-USY.

The shape selective medium pore crystalline zeolite catalyst can be present in the mixed catalyst system over widely varying levels. For example, the zeolite of the second catalyst component can be present at a level as low as about 0.01 to about 1.0 weight percent of the total catalyst inventory (as in the case of the catalytic cracking process of U.S. Pat. No. 4,368,114). In the present invention it can represent as much as 50 weight percent of the total catalyst system.

The catalytic cracking unit is preferably operated under fluidized flow conditions at a temperature within the range of from about 480° C. to about 735° C., a first catalyst component to charge stock ratio of from about 2:1 to about 15:1 and a first catalyst component contact time of from about 0.5 to about 30 seconds. Suitable charge stocks for cracking comprise the hydrocarbons generally and, in particular, petroleum fractions having an initial boiling point range of at least 205° C., a 50% point range of at least 260° C. and an end point range of at least 315° C. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 400° C. must be carried out under vacuum in order to avoid thermal cracking. The boiling temperatures utilized herein are expressed in terms of convenience of the boiling point corrected to atmospheric pressure.

Olefins Interconversion Reactor Operation

A typical olefins interconversion reactor unit employs a temperature-controlled catalyst zone with indirect heat exchange and/or fluid gas quench, whereby the reaction exotherm can be carefully controlled to prevent excessive temperature above the usual operating range of about 250° C. to 550° C., preferably at average reactor temperature of 300° C. to 500° C. The alkenes interconversion reactors operate at moderate pressure of about 100 to 3000 kPa, preferably 300 to 1500 kPa.

The weight hourly space velocity (WHSV), based on total olefins in the fresh feedstock is about 0.5-300. Catalyst activity is less than 100 alpha, preferably less than 7 alpha. The reactor is designed and operated under temperature WHSV, catalyst activity, and pressure conditions to produce less than 25% aromatics plus paraffins in the $C_5$+ components produced during the course of the reaction.

The use of a fluid-bed reactor in this process offers several advantages over a fixed-bed reactor. Due to catalyst withdrawal and makeup, fluid-bed reactor operation will not be adversely affected by oxygenate and/or nitrogen containing contaminants present in FCC light olefinic streams. In addition, the reactor temperature can be controlled to stay constant which allows optimizing the desired product yields. The most valuable products of the above-described reaction are iso-butene and iso-pentene which can be upgraded to MTBE and TAME.

The reaction temperature can be controlled by adjusting the feed temperature so that the enthalpy change balances the heat of reaction. The feed temperature can be adjusted by a feed preheater, heat exchange between the feed and the product, or a combination of both. Once the feed and product compositions are determined using, for example, an on-line gas chromatograph, the feed temperature needed to maintain the desired reactor temperature, and consequent olefin conversion, can be easily predetermined from a heat balance of the system. In a commercial unit this can be done automatically by state-of-the-art control techniques.

A typical light gas feedstock to the olefins interconversion reactor contains $C_2$-$C_6$ alkenes (mono-olefin), usually including at least 2 mole % ethene, wherein the total $C_2$-$C_3$ alkenes are in the range of about 10 to 40 wt. %. Non-deleterious components, such as hydrogen, methane and other paraffins and inert gases, may be present. The preferred feedstock is a $C_3$ by-product of FCC gas oil cracking units or $C_4$ olefins stream containing less than 7% iso-butene such as methanol and oxygenate containing $C_4$'s leaving an MTBE unit containing typically more than 35% olefins. The process may be tolerant of a wide range of lower alkanes, from 0 to 95%. Preferred feedstocks contain more than 50 wt. % $C_1$–$C_4$ lower aliphatic hydrocarbons, and contain sufficient olefins to provide total olefinic partial pressure of at least 50 kPa.

$C_6$+ olefins and/or n-$C_5$ olefin containing streams can also be upgraded to iso-olefinic $C_4$+.

The desired products are olefinic $C_4$ to $C_9$ hydrocarbons, which will comprise at least 70 wt. % of the net product, preferably 95% or more. Olefins comprise a predominant fraction of the $C_4$+ reaction effluent. It is desired to minimize paraffins and aromatics production, preferably to less than 10% and 2% by weight of the $C_5$+ made during the reaction, respectively.

The reaction severity conditions can be controlled to optimize yield of the most desired product namely C –$C_5$ olefinic isomers. Generally more than 10% of the olefins in the feed are upgraded to $C_4$–$C_5$ iso-olefins. Typically about 15 to 35% of the $C_4$-olefins in the feed can be converted to $C_4$–$C_5$ iso-olefins. It is understood that aromatics and light paraffin production is promoted by those zeolite catalysts having a high concentration of Bronsted acid reaction sites. Accordingly, an important criterion is selecting and maintaining catalyst inventory and operating conditions to minimize formation of aromatics and paraffins which reduce yield of desired iso-olefins. It is advantageous to employ a particle size range consisting essentially of 1 to 150 microns. Average particle size is usually about 20 to 100 microns, preferably 40 to 80 microns. Particle distribution may be enhanced by having a mixture of larger and smaller particles within the operative range, and it is particularly desirable to have a significant amount of fines. Close control of distribution can be maintained to keep about 10 to 25 wt % of the total catalyst in the reaction zone in the size range less than 32 microns. This class of fluidizable particles is classified as Geldart Group A. Accordingly, the fluidization regime is controlled to assure operation between the transition velocity and transport velocity. Fluidization conditions are substantially different from those found in non-turbulent dense beds or transport beds.

Developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolitic framework. These medium pore zeolites are favored for acid catalysis; however, the advantages of ZSM-5 structures may be utilized by employing highly siliceous materials or cystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The metallosilicate catalysts useful in the process of this invention may contain a siliceous zeolite generally known as a shape-selective ZSM-5 type. The members of the class of zeolites useful for such catalysts have an effective pore size of generally from about 5 to about 7 Angstroms such as to freely sorb normal hexane. In addition, the structure provides constrained access to larger molecules. A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g. less than 7 Angstroms. Large pore zeolites which provide relatively free access to the internal zeolite structure have a low value for the Constraint Index, and usually have pores of large size, e.g. greater than 8 Angstroms. The method by which Constraint Index is determined is described fully in U.S. Pat. No. 4,016,218,(Haag et al) incorporated herein by reference for details of the method.

The class of siliceous medium pore zeolites defined herein is exemplified by ZSM-5, ZSM-11, ZSM-12, ZSM-22, ZSM-23, ZSM-34, ZSM-35, ZSM-48, and other similar materials. ZSM-5 is described in U.S. Pat. No. 3,702,886 (Argauer et al); ZSM-11 in U.S. Pat. No. 3,709,979 (Chu); ZSM-12 in U.S. Pat. No. 3,832,449 (Rosinski et al); ZSM-22 in U.S. Pat. No, 4,046,859 (Plank et al); ZSM-23 in U.S. Pat. No. 4,076,842 (Plant et al); ZSM-35 in U.S. Pat. No. 4,016,245 (Plank et al); and ZSM-48 in U.S. Pat. No. 4,397,827 (Chu). The disclosures of these patents are incorporated herein by reference. While suitable zeolites having a coordinated metal oxide to silica molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt. % silica and/or alumina binder.

These siliceous zeolites may be employed in their acid forms ion exchanged or impregnated with one or more suitable metals, such as Ga, Pd, Zn, Ni Co and/or other metals of IUPAC Periodic Groups III to VIII. Phosphorous-modified zeolites may also be employed.

Certain of the ZSM-5 type medium pore shape selective catalysts are sometimes known as pentasils. In addition to the preferred aluminosilicates, the borosilicate, ferrosilicate and "silicalite" materials may be employed. It is advantageous to employ a standard ZSM-5 having a silica:alumina molar ratio of 25:1 to 70:1 with an apparent alpha value of 1–10 to convert 60 to 100 percent, preferably at least 70%, of the olefins in the feedstock to $C_5$ + hydrocarbons.

Usually the zeolite crystals have a crystal size from about 0.01 to over 2 microns or more, with 0.02–1 micron being preferred. In order to obtain the desired particle size for fluidization in the turbulent regime, the zeolite catalyst crystals are bound with a suitable inorganic oxide, such as silica, alumina, clay, etc. to provide a zeolite concentration of about 5 to 95 wt. %. In the description of preferred embodiments a 25% H-ZSM-5 catalyst contained within a silica-alumina matrix and having a fresh alpha value of about 80 is employed unless otherwise stated.

The Integrated System

The continuous multi-stage process disclosed herein successfully integrates a primary stage FCC operation and a secondary stage olefins olefin interconversion reaction to obtain a substantial increase in $C_4$+ iso-olefins yield. When the olefin interconversion reaction is conducted at low severity reaction conditions, a major proportion of light olefins by-product from the FCC operation is converted to valuable hydrocarbons. The integrated process comprises contacting heavy petroleum feedstock in a primary fluidized bed reaction stage with cracking catalyst comprising particulate solid large pore acid aluminosilicate zeolite catalyst at conversion conditions to produce a hydrocarbon effluent comprising light gas containing lower molecular weight olefins, intermediate hydrocarbons in the gasoline and distillate range, and cracked bottoms; separating the light gas containing lower molecular weight olefins; reacting at least a portion of the light gas in a secondary fluidized bed reactor stage in contact with medium pore acid zeolite catalyst particles under reaction conditions to effectively convert a portion of the lower molecular weight olefins to olefinic hydrocarbons boiling in the gasoline and/or distillate range; withdrawing a portion of catalyst from the secondary fluidized bed reaction stage; and passing the withdrawn catalyst portion to the primary fluidized bed reaction stage for contact with the heavy petroleum feedstock. The FCC wash water makeup is preferably utilized to extract any impurities from the secondary stage feed. The extractor bottoms is then used as FCC wash water makeup. This eliminates the need to provide regeneration facilities for the extractor bottom stream. Other olefinic streams such as coker light olefins or $C_5$s or $C_5+$ olefinic components from TAME, FCC, or interconversion unit may also be processed in the second stage reaction system.

In a most preferred embodiment, the process comprises: maintaining a primary fluidized bed reaction stage containing cracking catalyst comprising a mixture of crystalline aluminosilicate particles having an effective pore size greater than 8 Angstroms and crystalline medium pore zeolite particles having an effective pore size of about 5 to 7 Angstroms; converting a feedstock comprising a heavy petroleum fraction boiling above about 250° C. by passing the feedstock upwardly through the primary stage fluidized bed in contact with the mixture of cracking catalyst particles under cracking conditions of temperature and pressure to obtain a product stream comprising intermediate and lower boiling hydrocarbons; separating the product stream to produce olefinic light gas, intermediate products containing $C_3$–$C_4$ olefins, gasoline and distillate range hydrocarbons, and a bottoms fraction; maintaining a secondary fluidized bed reaction stage containing light olefins conversion catalyst comprising crystalline medium pore acid zeolite particles having an average alpha value of about 1–7 and an effective pore size of about 5 to 7 Angstroms which may be steamed prior to its introduction to the interconversion reactor; contacting at least a portion of $C_3$–$C_4$ olefins (the FCC $C_4$'s may be partially etherified upstream of this reactor to upgrade FCC iso-butene to MTBE) with particles in the secondary fluidized bed reaction stage under reaction severity conditions to obtain etherifiable iso-butene, iso-pentenes and etherifiable iso-olefinic gasoline and/or distillate product; withdrawing from the secondary stage a portion of catalyst particles having preferably at least 1% coke content; and adding the zeolite catalyst particles to the primary fluidized bed reaction stage for admixture with the cracking catalyst. At least a portion of the FCC ethene rich gas can be added to the $C_3$–$C_4$ olefins prior to contact with light olefins conversion catalyst in the secondary stage. In this case the interconversion reaction section is preferably placed upstream of the gas plant to minimize additional fractionation system requirement. Additional fresh catalyst having a pore size of 5 to 7 Angstroms can be admixed with the catalysts added to the first stage.

It is not necessary for the practice of the present process to employ as feedstock for the olefins interconversion reaction zone the light olefins from the integrated FCC unit. It is contemplated that any feedstock containing lower molecular weight olefins ($C_2$–$C_{12}$) can be used, regardless of the source.

It has also been found that heavy petroleum feedstocks can be more easily and efficiently converted to valuable hydrocarbon products by using an apparatus comprising a multi-stage continuous fluidized bed catalytic reactor system which comprises primary reactor means for contacting feedstock with a fluidized bed of solid catalyst particles under cracking conditions to provide liquid hydrocarbon product and reactive hydrocarbons; primary catalyst regenerator means operatively connected to receive a portion of catalyst from the primary reactor means for reactivating said catalyst portion; primary activated catalyst handling means to conduct at least a portion of reactivated catalyst from the primary regenerator means to the primary reactor means; means for recovering a reactive hydrocarbon stream; second reactor means for contacting at least a portion of the reactive hydrocarbons under low severity conversion conditions with a fluidized bed of solid catalyst particles to further convert reactive hydrocarbons to additional liquid hydrocarbon product and thereby depositing by-product coke onto the catalyst particles. Catalyst handling means is provided to conduct a portion of the reactor catalyst from the secondary reactor means to the primary reactor means or regenerator means for further heavy petroleum feedstock conversion use.

Preferably no stripping means is used for the second stage reaction zone since the entrained hydrocarbons can be recovered in the first stage processing. In addition, the spent catalyst is preferably carried by the dispersion steam continuously injected to the FCC riser. The second stage spent catalyst is preferably added to the primary reactor means to allow upgrading and recovering of entrained hydrocarbons and at least a portion of the coke on catalyst at the high temperature that the primary stage reactor operates at. This minimizes exposure of a relatively high hydrocarbon content second stage catalyst to air regeneration at high temperature in the primary regeneration means that can cause very high temperatures on the catalyst particles which can permanently inactivate the catalyst.

FIG. 1 illustrates a process scheme for practicing the present invention. The flow of chemicals beginning with the heavy hydrocarbons feed at line 1 is schematically represented by solid lines. The flow of catalyst particles is represented by dotted lines. Chemical feedstock passes through conduit 1 and enters the first stage fluidized bed cracking reactor 10. The feed can be charged to the reactor with a diluent such as hydrocarbon or steam. Deactivated catalyst particles are withdrawn from fluidized bed reaction zone 10 via line 3 and passed to catalyst regeneration zone 40, where the particles having carbonaceous deposits thereon are oxidatively regenerated by known methods. The regenerated catalyst particles are then recycled via line 5 to reaction zone 10.

A portion of secondary stage catalyst is sent via conduit 37 to first fluid bed reaction zone 10. Fresh medium pore zeolite catalyst can be admixed with the regenerated catalyst as by conduit 39. Also, fresh medium pore zeolite catalyst is added to olefins upgrading reaction zone 30 via conduit 20.

Cracked product from the FCC reaction zone 10 is withdrawn through conduit 2 and passed to a main fractionation tower 4 where the product is typically separated into a light gas stream, a middle stream, and a bottoms stream. The middle stream is recovered via conduit 12 and the bottoms stream is withdrawn through conduit 11. The light gas stream is withdrawn through conduit 6 and enters gas plant 8 for further separation. A middle fraction is drawn from the gas plant via conduit 14 and a heavy fraction is withdrawn via conduit 13. A stream comprising lower olefins is withdrawn via conduit 7 and enters olefin interconversion unit 30 where the stream contacts siliceous medium pore zeolite catalyst particles in a turbulent regime fluidized bed to form a hydrocarbon product rich in $C_5$ + hydrocarbons boiling in the gasoline and/or distillate range. The hydrocarbon product is removed from the olefins interconversion zone 30 through conduit 9 for further processing.

The catalyst inventory in the FCC reactor preferably comprises zeolite Y which is impregnated with one or more rare earth elements (REY). This large pore cracking catalyst is combined in the FCC reactor with the ZSM-5 withdrawn from the olefin interconversion reactor catalyst regeneration zone to obtain a mixed FCC cracking catalyst which provides a gasoline yield having improved octane number and an increased yield of lower molecular weight olefins which can be upgraded in the etherification reactor, olefin interconversion reactor, or an alkylation unit (not shown).

Advantageously, the catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage to increase octane by 0.2–5 Research (base 92 Research).

Catalyst inventory in the fluidized catalytic cracking unit may be controlled so that the ratio of cracking catalyst to the added zeolite olefin interconversion catalyst is about 1:1 to about 50:1. In a preferred example the zeolite olefin interconversion catalyst has an apparent acid cracking value of about 1 to 7 when it is withdrawn from the fluidized bed olefin interconversion unit for recycle to the FCC unit. The fresh medium pore catalyst for the olefin interconversion unit and the FCC unit has an apparent acid cracking value about 10 and above.

In a preferred example, the total amount of fluidized catalyst in the FCC reactor is about ten times as much as the amount of fluidized catalyst in the olefin interconversion reactor. To maintain equilibrium catalyst activity in the FCC reactor, fresh Y zeolite catalyst particles are added in an amount of about 1 to 2 percent by weight based on total amount of catalyst present in the FCC reactor. Spent cracking catalyst is then withdrawn for subsequent disposal from the FCC regenerator in an amount substantially equivalent to the combination of fresh REY zeolite catalyst and partially deactivated ZSM-5 catalyst which is added to the reactor.

In a typical example of the present process, an FCC reactor is operated in conjunction with an olefin interconversion reactor. The catalyst flow rates per day are adjusted so that about 1.25 percent by weight of fresh large pore zeolite cracking catalyst based on total amount of catalyst present in the FCC reactor is added to the FCC reactor; about 10.0 percent by weight fresh zeolite ZSM-5 catalyst based on total amount of catalyst present in the olefins interconversion reactor is added to the olefins interconversion reactor; and about 10.0 percent by weight of zeolite ZSM-5 catalyst based on total amount of catalyst present in the olefins interconversion reactor is withdrawn from the olefins interconversion reactor, and added to the catalyst inventory of the FCC reactor. The gasoline range hydrocarbons obtained from the FCC reactor have an increased octane rating (using the R+M/2 method, where R=research octane number and M=motor octane number) of 0.7. The distillate range hydrocarbons obtained directly or after further high pressure upgrading from the olefins interconversion reactor typically have a cetane rating of 52 after hydrotreating.

While the invention has been described by reference to certain embodiments, there is no intent to limit the inventive concept except as set forth in the following claims:

I claim:

1. A continuous multi-stage process for increasing octane quality and yield of liquid hydrocarbons from an integrated fluidized catalytic cracking unit and olefins interconversion reaction zone comprising:

contacting heavy hydrocarbon feedstock in a primary fluidized bed reaction stage with cracking catalyst comprising particulate solid large pore acid aluminosilicate zeolite catalyst at conversion conditions to produce a hydrocarbon effluent comprising gas containing $C_2$–$C_4$ olefins, intermediate hydrocarbons in the gasoline and distillate range, and cracked bottoms;

regenerating primary stage zeolite cracking catalyst in a primary stage regeneration zone and returning at least a portion of regenerated zeolite cracking catalyst to the primary reaction stage;

recovering and reacting the olefinic gas containing at least one olefin from the range of $C_2$–$C_4$ olefins in a secondary fluidized bed reactor stage in contact with a closed fluidized bed of acid zeolite catalyst particles consisting essentially of medium pore shape selective zeolite under olefin interconversion reaction conditions to effectively convert $C_2$–$C_4$ olefin to olefinic hydrocarbons rich in $C_4$–$C_5$ isoalkenes and containing a $C_5$+ concentration of less than 8 wt % paraffins and less than 2 wt % aromatics;

adding fresh acid medium pore zeolite particles to the secondary stage reactor in an amount sufficient to maintain average equilibrium catalyst particle activity for selective isoalkene yield without regeneration of the secondary catalyst bed;

withdrawing a portion of equilibrium catalyst from the secondary fluidized bed reactor stage; and passing said withdrawn catalyst portion to the primary fluidized bed reaction stage for contact with the heavy hydrocarbon feedstock.

2. A process according to claim 1 wherein equilibrium catalyst withdrawn from the second fluidized bed reaction stage is in partially deactivated form and has an average alpha value of about 1 to 7 and wherein reaction severity conditions are maintained to obtain interconversion effluent having a molar ration (R.I.) of propane to propene in the range of 0.01:1 to 3.0:1.

3. A process according to claim 1 wherein fresh catalyst having an average alpha value of at least about 5 is added to the second fluidized bed reaction stage to maintain acid activity of the equilibrium catalyst.

4. A process according to claim 2 including the steps of separating primary stage effluent to recover olefinic gas containing $C_2$–$C_4$ olefins; and washing said olefins from the primary reaction stage to remove water-soluble impurities prior to contacting medium pore catalyst in the secondary reaction stage.

5. A process according to claim 4 wherein said medium pore zeolite is ZSM-5 or ZSM-23 and wherein the equilibrium catalyst has deposited thereon up to about 15 wt % of coke.

6. A continuous multi-stage process for increasing production of high octane gasoline range hydrocarbons from crackable petroleum feedstock comprising:

contacting the feedstock in a primary fluidized catalyst reaction stage with a mixed catalyst system which comprises finely divided particles of a first large pore cracking catalyst component and finely divided particles of a second medium pore siliceous zeolite catalyst component under cracking conditions to obtain a product comprising intermediate gasoline and distillate range hydrocarbons, and an olefinic gas rich in $C_2$–$C_4$ olefins;

separating the olefinic gas and contacting at least a fraction of said olefins with particulate catalyst solids consisting essentially of medium pore siliceous zeolite catalyst in a secondary fluidized bed reaction stage under low severity reaction conditions effective to upgrade said olefins to predominantly $C_4$ + hydrocarbons rich in isobutylene and isoamylenes, thereby depositing about 3–7 wt % carbonaceous material onto the particulate zeolite catalyst to obtain a coked equilibrium catalyst;

withdrawing a portion of partially deactivated equilibrium particulate zeolite catalyst from the secondary reaction stage; and adding a said withdrawn coked equilibrium zeolite catalyst to the primary fluidized reaction stage for conversion of crackable petroleum feedstock, whereby catalyst makeup of the primary fluidized catalyst reaction stage and the secondary fluidized bed reaction stage is balanced; wherein catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage.

7. A process for integrating catalyst inventory of a fluidized catalytic cracking unit and a fluidized bed reaction zone for interconversion of olefins to enhance production of tertiary alkenes, the process comprising;

maintaining a primary fluidized bed reaction stage containing acid cracking catalyst comprising a mixture of crystalline aluminosilicate particles having a pore size greater than 8 Angstroms and crystalline medium pore zeolite particles having a pore size of about 5 to 7 Angstroms;

converting a feedstock comprising a petroleum fraction boiling above about 250° C. by passing the feedstock upwardly through the primary stage fluidized bed in contact with the mixture of cracking catalyst particles under cracking conditions of temperature and pressure to obtain a product stream comprising cracked hydrocarbons, including propene, butene and gasoline product;

separating the product stream to recover a light olefinic stream containing propene or butene;

maintaining a secondary fluidized bed reaction stage containing fluidized finely divided olefins conversion catalyst comprising crystalline medium pore acid zeolite having an average alpha value of about 1 to 10 and a pore size of about 5 to 7 Angstroms, wherein reaction severity is maintained to provide about 0.01:1 to 3:1 ratio of propane to propene in the net product obtained from the secondary fluidized bed reaction stage;

contacting at least a portion of the olefinic gas with said medium pore zeolite particles in the secondary fluidized bed reaction stage under olefin interconversion reaction conditions at a temperature of about 300–500° C. to obtain olefinic product rich in isobutene and isopentene;

withdrawing from the secondary stage a portion of catalyst particles; and adding the withdrawn zeolite catalyst particles to the primary fluidized bed reaction stage containing cracking catalyst.

8. A process according to claim 7 wherein the catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage to increase gasoline product octane by 0.2–2 research octane number.

9. A process according to claim 7 wherein $C_3$–$C_4$ olefins comprise a major amount of the light olefinic stream fed to the secondary fluidized bed reaction stage; and wherein the secondary stage interconversion reaction is conducted at a weight hourly space velocity of about 0.5 to 80, based on light olefins in the feed and total secondary fluidized catalyst weight.

10. A process according to claim 7 wherein the secondary stage interconversion effluent contains $C_5$+ hydrocarbons with less than 8 wt % paraffins and less than 2 wt % aromatics concentration; and wherein the secondary stage interconversion feed stream consists essentially of $C_3$–$C_4$ light olefinic gas.

11. A process according to claim 10 wherein the secondary stage interconversion product contains about 70–95 wt % $C_4$–$C_9$ olefinic hydrocarbons.

12. A process according to claim 7 wherein the secondary stage interconversion is operated at reaction severity index to produce net propane and propene in a weight ratio less than 0.09:1 and to provide a coke make less than 0.1 wt % of olefin in the light olefinic stream.

* * * * *